US010829983B2

(12) United States Patent
Haba et al.

(10) Patent No.: US 10,829,983 B2
(45) Date of Patent: Nov. 10, 2020

(54) IMPACT RESISTANT FULL VIEW DOOR

(71) Applicant: Overhead Door Corporation, Lewisville, TX (US)

(72) Inventors: Charles A. Haba, Massillon, OH (US); Dwayne J. Kornish, Navarre, OH (US); Gregory R. Taylor, Cantonment, FL (US)

(73) Assignee: Overhead Door Corporation, Lewisville, TX (US)

( * ) Notice: Subject to any disclaimer, the term of this patent is extended or adjusted under 35 U.S.C. 154(b) by 252 days.

(21) Appl. No.: 15/443,574

(22) Filed: Feb. 27, 2017

(65) Prior Publication Data

US 2017/0247937 A1 Aug. 31, 2017

Related U.S. Application Data

(60) Provisional application No. 62/301,246, filed on Feb. 29, 2016.

(51) Int. Cl.

| | |
|---|---|
| ***E06B 3/54*** | (2006.01) |
| ***E06B 3/58*** | (2006.01) |
| ***E06B 3/70*** | (2006.01) |
| ***E06B 3/48*** | (2006.01) |
| ***E06B 3/30*** | (2006.01) |

(52) U.S. Cl.

CPC ..... *E06B 3/5892* (2013.01); *E06B 3/308* (2013.01); *E06B 3/485* (2013.01); *E06B 3/54* (2013.01); *E06B 3/549* (2013.01); *E06B 3/5436* (2013.01); *E05Y 2900/106* (2013.01); *E06B 2003/7044* (2013.01)

(58) Field of Classification Search

CPC ..... E06B 3/5892; E06B 3/485; E06B 3/5878; E06B 2003/7044; E06B 3/54; E06B 3/5436; E06B 3/549

See application file for complete search history.

(56) References Cited

U.S. PATENT DOCUMENTS

| | | | | | |
|---|---|---|---|---|---|
| 2,374,056 | A * | 4/1945 | Watkins | B32B 17/10036 | 156/102 |
| 4,733,510 | A * | 3/1988 | Werner | E06B 3/28 | 428/34 |
| 4,897,975 | A * | 2/1990 | Artwick | E06B 3/5821 | 52/208 |
| 5,189,862 | A * | 3/1993 | Lafleur | E06B 3/2605 | 52/204.593 |
| 5,497,588 | A | 3/1996 | Martin et al. | | |
| 5,570,548 | A * | 11/1996 | Hopper | E06B 3/22 | 52/204.5 |

(Continued)

*Primary Examiner* — Justin B Rephann

(74) *Attorney, Agent, or Firm* — Haynes and Boone, LLP

(57) ABSTRACT

An overhead door includes a plurality of articulating panels. At least one of the plurality of articulating panels includes a frame defining an opening, the frame having a ledge and a lip extending from the ledge into the opening and a transparent panel having a first side and an opposing second side. The transparent panel is positioned adjacent to both the lip and the ledge with the first side of the transparent panel positionable adjacent the lip. The plurality of articulating panels further includes a retainer member positionable adjacent the second side of the transparent panel and operable to be fastened to the frame.

16 Claims, 3 Drawing Sheets

(56) References Cited

U.S. PATENT DOCUMENTS 5,577,355 A * 11/1996 Leonelli ..... E06B 3/5892 52/204.591
6,151,849 A * 11/2000 Twigg ..... E06B 3/5892 52/204.53
6,318,037 B1 * 11/2001 Hansen ..... E06B 1/30 52/204.54
6,546,682 B1 * 4/2003 DeBlock ..... B32B 17/10 52/204.68
6,647,677 B1 * 11/2003 Berger, Jr. ..... E06B 3/5892 52/204.1
6,708,458 B1 3/2004 Berger, Jr.
6,837,011 B2 * 1/2005 Berger, Jr. ..... E06B 3/5892 52/204.591
7,954,285 B2 * 6/2011 Taylor ..... E06B 3/5892 52/204.53
8,201,367 B2 6/2012 Barnard et al.
8,479,462 B1 * 7/2013 Sahadeo ..... E06B 3/28 160/368.1
8,813,442 B1 * 8/2014 Edwards ..... E06B 3/5892 52/204.5
9,022,091 B2 5/2015 Shives
2003/0000164 A1 * 1/2003 Berger, Jr. ..... E06B 3/5892 52/208
2003/0066256 A1 * 4/2003 DeBlock ..... B32B 17/10 52/208
2005/0055906 A1 * 3/2005 Barnard ..... E06B 3/5892 52/204.1
2007/0193140 A1 * 8/2007 Carnick ..... E06B 3/5892 52/208
2007/0261326 A1 * 11/2007 Krochmal ..... E06B 3/5878 52/204.2
2009/0241422 A1 * 10/2009 Mock ..... E06B 3/5892 49/197
2009/0277109 A1 * 11/2009 Taylor ..... E06B 3/485 52/208
2010/0287839 A1 * 11/2010 Barnard ..... E06B 3/5892 49/197
2012/0055106 A1 * 3/2012 Phipps ..... E06B 7/30 52/204.591
2014/0262072 A1 * 9/2014 Shives ..... E06B 3/485 160/201
2018/0238102 A1 * 8/2018 Kornish ..... E06B 3/485

* cited by examiner

IMPACT RESISTANT FULL VIEW DOOR

CLAIM OF PRIORITY

This application claims priority to U.S. Provisional Patent Application No. 62/301,246 filed Feb. 29, 2016, which is incorporated herein by reference in its entirety.

TECHNICAL FIELD

The present invention relates generally to a multi-panel door, and, more particularly, to an impact resistant door, and even more particularly, to an impact resistant full view door.

BACKGROUND

Multi-panel doors of the type used for closing a large opening in a building, such as a garage door, have long been manufactured using a plurality of substantially identical panels. The plurality of panels are typically hingedly or pivotally connected together to permit relative hinging movement between adjacent panels when the door is moved between a closed, vertical position, and an open, horizontal position.

Such multi-panel doors are commonly referred to as upward opening sectional doors and often include panels formed of a shell or casing, such as a molded or stamped piece of metal, fiberglass, or plastic, and an insulating core. In some cases, the multi-panel door includes windows positioned within one or more of the panels to allow users to view through a portion of the door. Due to the lightweight shell and core used to form the panels, multi-panel doors often require cumbersome, external framing structures to hold the windows in place within an opening cut into the panel. The windows and framing structures of such doors often provide for a limited viewing area through the door, have low resistance to wind forces and flying debris that may occur in hurricane prone areas, and be cumbersome additions to the panels.

SUMMARY

In a first embodiment, an overhead door includes a plurality of articulating panels. At least one of the plurality of articulating panels includes a frame defining an opening, the frame having a ledge and a lip extending from the ledge into the opening and a transparent member having a first side and an opposing second side. The transparent member is positioned adjacent to both the lip and the ledge with the first side of the transparent member positionable adjacent the lip. The plurality of articulating panels further includes a retainer member positionable adjacent the second side of the transparent member and operable to be fastened to the frame.

In certain aspects, the frame is formed of aluminum extrusions.

In some aspects, the second side of the transparent member includes a groove.

In other aspects, the retainer member has a rib operable to fit in a groove formed along a periphery of the transparent member.

In yet another aspect, the door further comprises a fastener operable to fasten the retainer member to the frame, wherein the fastener is inserted into the retainer member at an angle of approximately 30 degrees relative to the ledge.

In certain aspects the door further comprises a fastener operable to fasten the transparent member to the lip.

In a second embodiment, a panel of a sectional door includes a panel frame having a top frame member, a bottom frame member, a first side frame member and a second side frame member such that the frame members form an opening. The frame members include a rear surface and a front surface with a ledge at least partially extending between the rear surface and the front surface of the frame members and a lip extending from the front side of the frame members into the opening.

In certain aspects, the panel further comprises a sheet of material positioned adjacent to the lip and the ledge such that an edge of the sheet is positioned adjacent on the ledge and a periphery of an outer surface of the sheet is positioned against the lip.

In some aspects, the edge of the sheet directly contacts at least a portion of the ledge.

In other aspects, the lip and the ledge are perpendicular to each other.

In yet another aspect, the sheet has a groove formed along the periphery of an inner surface.

In certain aspects, the sheet is tempered glass.

In some aspects, the sheet is polycarbonate.

In other aspects, the panel further comprises one or more retainer members configured to be fastened to one or more of the frame members.

In yet another aspect, the panel frame members are aluminum extrusions.

In a third embodiment, an upward acting, multi-panel door includes a plurality of panel frames. Each panel frame of the plurality of panel frames includes an inward facing surface, an outward facing surface, a ledge at least partially extending between the inward facing surface and the outward facing surface, and a lip extending from the outward facing surface.

In certain aspects, the door further comprises an opening formed by the each panel frame.

In some aspects, the door further comprises an opening formed by the each panel frame and a window positioned in the opening.

In other aspects, the door further comprises an opening formed by the each panel frame, a window having a first side and a second side and positioned in the opening, and a retainer member positioned adjacent the second side of the window and fastened to the each panel frame.

In yet another aspect, the each panel frame is formed of aluminum extrusions.

For a more complete understanding of the present invention, including additional features, objects and advantages thereof, reference is now made to the following detailed description taken in conjunction with the drawings, in which:

DETAILED DESCRIPTION

Figure 1:
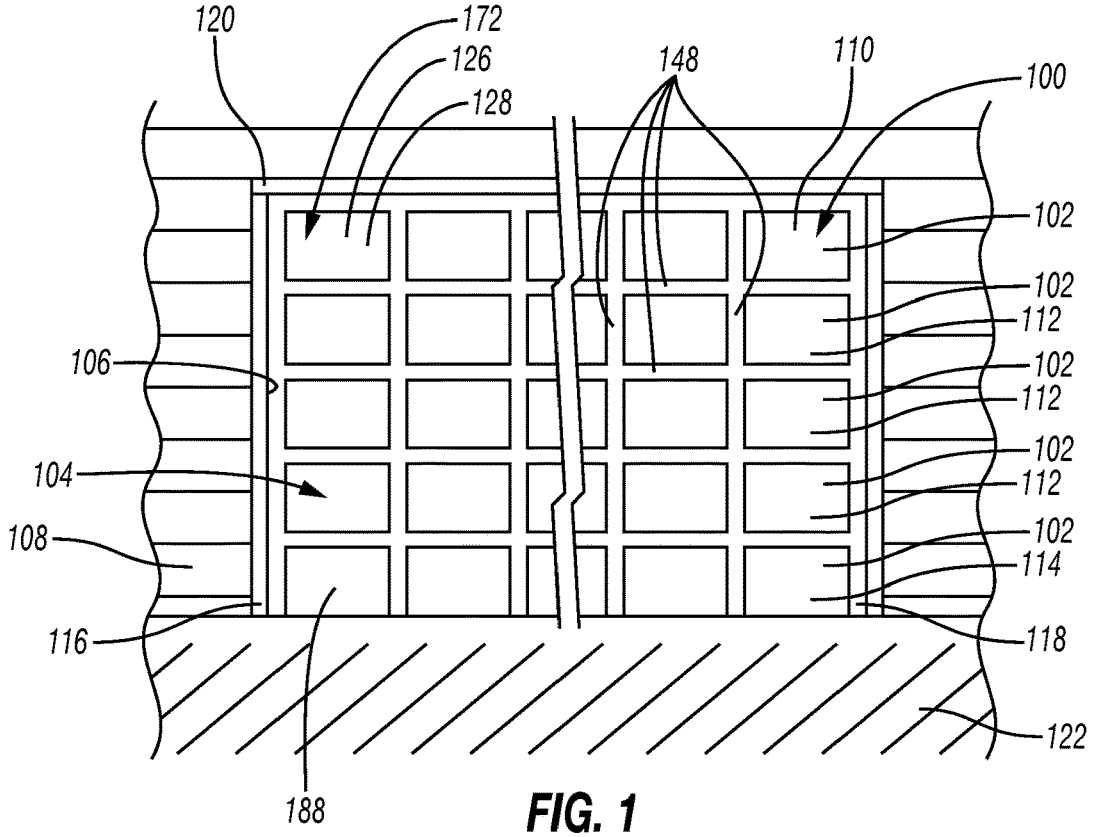
FIG. 1 is a front view of an embodiment of a multi-panel door in accordance with this disclosure.

In the description which follows, like parts are marked throughout the specification and drawings with the same reference numerals. The drawings may not be to scale and certain features may be shown exaggerated in scale or in somewhat schematic form in the interest of clarity and conciseness.

FIG. 1 illustrates an embodiment of a multi-panel, upward-acting, sectional door 100 rated for hurricane areas such that the door 100 is impact resistant, while still providing a full view through the door 100. The multi-panel door 100 includes a plurality of panels 102 that together form a front face 104 of the door 100 and enclose an opening 106 in a building 108 or other structure. In the embodiment illustrated in FIG. 1, for example, the door 100 includes a number of panels 102, namely, a top panel 110, several intermediate panels 112 and a bottom panel 114 that enclose the opening 106 defined by two jambs 116, 118, a header 120 and a driveway 122. In other embodiments, the door 100 may include any number of panels 102 and may be located in any suitable opening 106. For example, the door 100 may include the top panel 110, one intermediate panel 112 and the bottom panel 114. The panels 102 may be hingedly connected and mounted on conventional track and rollers (not shown) within the building to enable movement of the door 100 between the vertical (closed) position shown in FIG. 1, and a horizontal (i.e., open or overhead) position.

Figure 2:
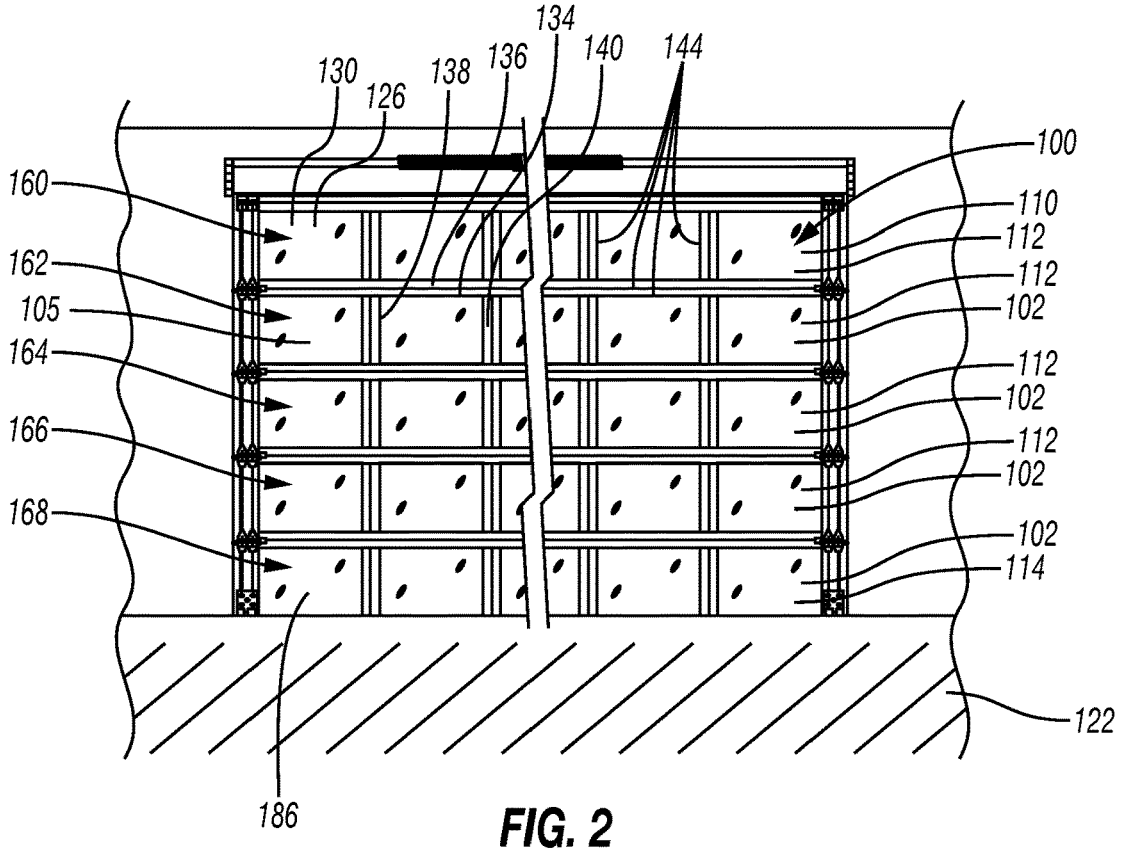
FIG. 2 is a rear view of the multi-panel door of FIG. 1.
Figure 3:
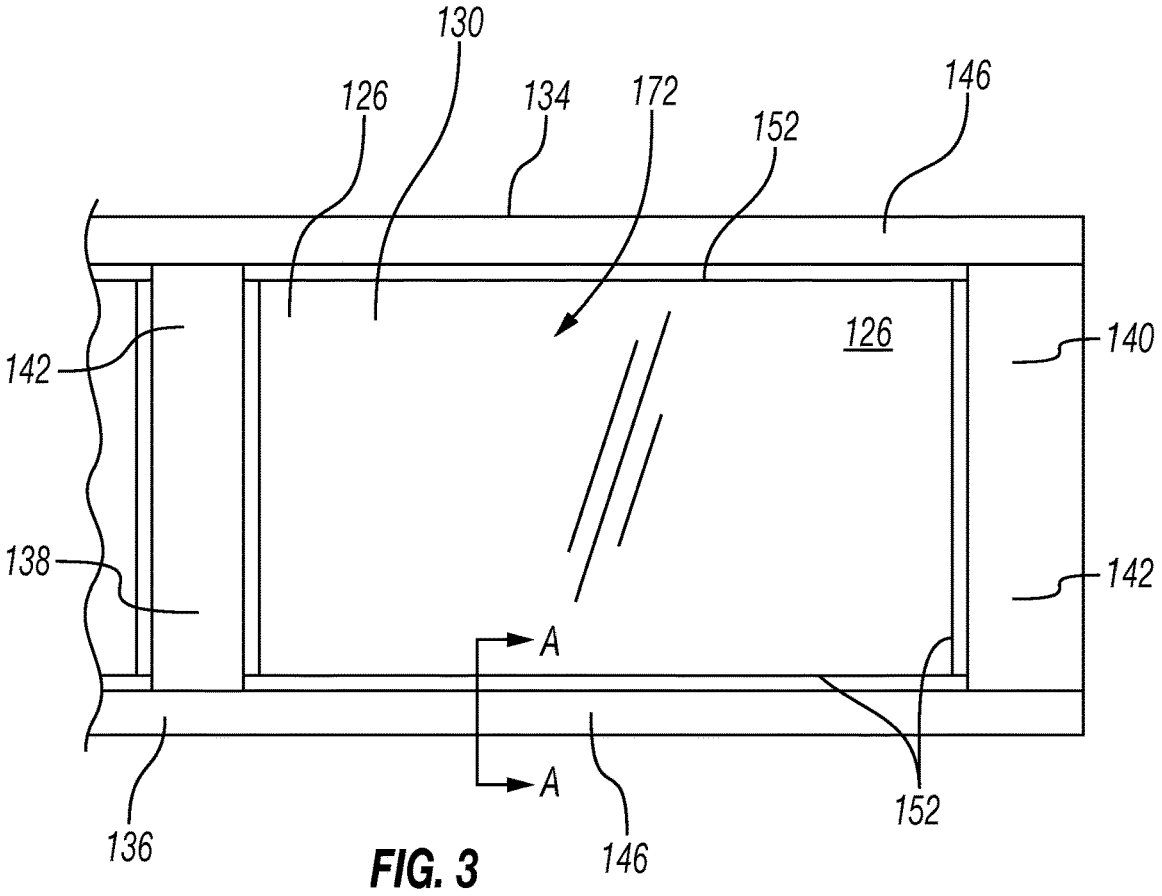
FIG. 3 is a detailed view of a panel according to the multi-panel door of FIG. 1.

Referring to FIGS. 1-3, a nonlimiting, illustrative embodiment of the door 100, which is configured so that the door 100 is operable for use in hurricane prone areas, is employed to advantage. Each of the panels 102 is comprised of one or more interconnected frames 160, 162, 164, 166, 168. The panels 102 further include one or more sheets or members 126 positionable within the frames 160, 162, 164, 166, 168 and retainer members 152 to hold the one or more sheets 126 within the frames 160, 162, 164, 166, 168. In some embodiments, the top panel 110 includes a plurality of frames 160, the intermediate panels 112 include a plurality of frames 162, 164, 166, and the bottom panel 114 includes a plurality of frames 168. Thus, the frames 160 form the framing for the top panel 110, the frames 162, 164 and 166 form the framing for the intermediate panels 112, and the frames 168 form the framing for the bottom panel 114. In some aspects, each of the panels 102 is formed of a single frame. Each of the frames 160, 162, 164, 166, 168 includes an inward facing surface 186 and an outward facing surface 188. The inward facing surface 186 faces an interior portion of the space enclosed by the door 100, such as the interior portion of a garage. The outward facing surface 188 faces an exterior or away from the space enclosed by the door 100.

Each of the panel frames 160, 162, 164, 166, 168 includes an upper frame member 134, a lower frame member 136, a first side member 138 and a second side member 140. The frame members 134, 136, 138, 140 are coupled together to form the panel frames 160, 162, 164, 166, 168 or a portion of the panel frames 160, 162, 164, 166, 168. In some embodiments, the upper frame member 134, the lower frame member 136, the first side member 138 and the second side member 140 are metal extrusions that are coupled to form an opening 172. Prior art panels (not shown), in contrast, are generally formed from a shell or casing, such as a molded or stamped piece of metal.

In an embodiment, the frame members 134, 136, 138, 140 form a rectangular shape forming a rectangular opening 172. In one illustrative embodiment, the frame members 134, 136, 138, and 140 are formed from aluminum through an extrusion process. Other known types of metal may be used. It should further be appreciated that while the frame members 134, 136, 138, 140 and the opening 172 is shown as forming a rectangle, other suitable shapes may be utilized in other embodiments.

Referring specifically to FIG. 3 with continued reference to FIGS. 1 and 2, the panel frames 160, 162, 164, 166, 168 may also include one or more intermediate frame members 142 and 146. For example, in the embodiment illustrated in FIG. 3 each of the panel frames 160, 162, 164, 166, 168 includes a vertical intermediate frame member 142 that extends between and couples the upper frame member 134 to the lower frame member 136 or otherwise replaces the upper and lower frame members 134, 136 and divides the frames 160, 162, 164, 166, 168 into two sections. In some aspects, the vertical intermediate frame member 142 divides the frames 160, 162, 164, 166, 168 into two equal sections. Likewise, in the embodiment illustrated in FIG. 3 each panel frame 160, 162, 164, 166, 168 includes a horizontal intermediate frame member 146 that extends between and couples the first side members 138 to the second side members 140 or otherwise replaces the first and second side frame members 138, 140 and divides the frames 160, 162, 164, 166, 168 into two sections. In some aspects, the vertical intermediate frame member 146 divides the frames 160, 162, 164, 166, 168 into two equal sections. The intermediate frame members 142, 146 may be metal extrusions and may also be formed from aluminum.

Each of the frame members 134, 136, 138, 140, 142, 146 includes an inner surface 144 that faces an interior portion of the space enclosed by the door 100, such as the interior portion of a garage, and an outer surface 148 that faces an exterior or away from the space enclosed by the door 100. In some embodiments, the inner and outer surfaces 144, 148 of the frame members 134, 136, 138, 140, 142, 146 are substantially co-planar when the door 100 is in the vertical position, as illustrated in FIGS. 1 and 2.

The frame members 134, 136, 138, 140, 142, 146 are assembled to form the respective panel frames 160, 162, 164, 166, or 168. As previously mentioned, the frame members 134, 136, 138, 140, 142, 146 may form a rectangular shape such that the panel frames 160, 162, 164, 166, 168 create the opening 172. The frame members 160, 162, 164, 166, 168 are assembled to form a suitable shape with the opening 172 formed therein. The one or more sheets 126 are configured to fit in the opening 172.

Figure 4:
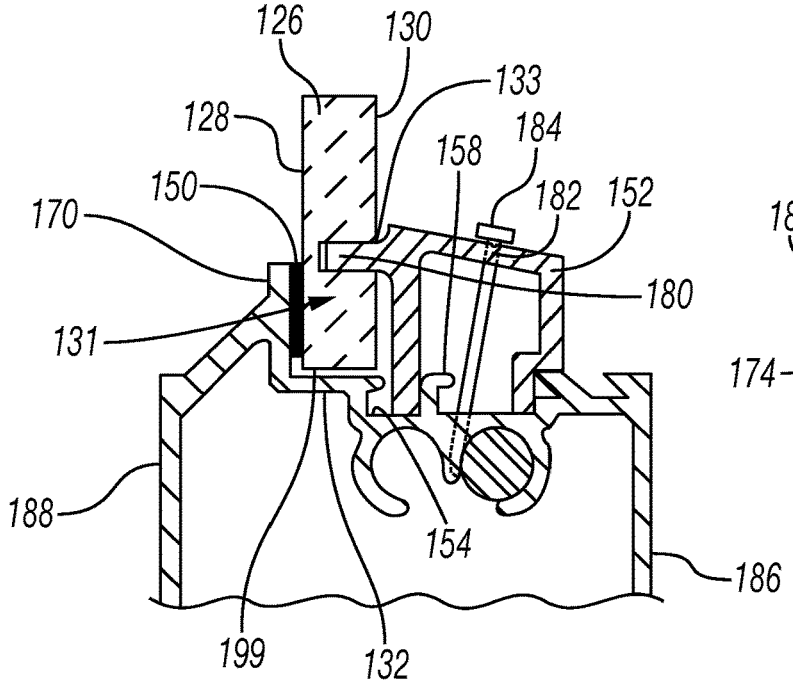
FIG. 4 is a cross section view of FIG. 3 taken along line A-A.

Referring now to FIG. 4, the frame members 134, 136, 138, 140, 142, 146 include a ledge or window ledge 132 that at least partially extends between the inner surface 144 and the outer surface 148 of the frame members 160, 162, 164, 166, 168 or otherwise extends between the inner and outer surfaces 186, 188 of the frames 160, 162, 164, 166, 168. The ledge 132 may be operable to at least partially support the weight of the one or more sheets 126. In other embodiments, a gap 199 exists between the ledge 132 and the one or more sheets 126. It should be appreciated that since each of the frame members 134, 136, 138, 140, 142, 146 may include the ledge 132, one or more of the respective ledges 132 may at least partially support the weight of the one or more sheets 126, the gap 199 may exist between the ledge 132 and the one or more sheets 126, or a combination thereof may exist. In some aspects, the ledge 132 is substantially perpendicular to the exterior surface 148 and the interior surface 144 of the frame members 134, 136, 138, 140, 142, 146 or the ledge is otherwise perpendicular to the inner and outer facing surfaces 186, 188 of the frames 160, 162, 164, 166, 168.

In some embodiments, the frame members 134, 136, 138, 140, 142, 146 or the frames 160, 162, 164, 166, 168 further includes a shoulder 154 positioned proximate the ledge 132. In these embodiments, the shoulder 154 also at least partially extends between the inner and outer surfaces 144, 148 of the frame members 134, 136, 138, 140, 142, 146 or otherwise stated, between the inner and outer surfaces 186, 188 of the frame members 134, 136, 138, 140, 142, 146. The shoulder 154 may be perpendicular to the inner and outer surface 144, 148 of the frame members 134, 136, 138, 140, 142, 146 and the inner and outer facing surfaces 186, 188 of the frames 160, 162, 164, 166, 168. In a nonlimiting, illustrative embodiment, the ledge 132 is parallel to the shoulder 154. Other suitable configurations are possible in other embodiments. For example, the shoulder 154 may be angled relative to the ledge 132.

The shoulder 154 is operable to support or otherwise be coupled to the retainer member 152. In some embodiments, the shoulder 154 includes a first protrusion 158 and a second protrusion 159 extending therefrom for securing the retainer member 152 to the shoulder 154 and ultimately to the frame 160, 162, 164, 166, 168. It should be appreciated that in some embodiments, not all of the frame members 134, 136, 138, 140, 142, 146 require a ledge 132 and/or a shoulder 154.

The frame members 134, 136, 138, 140, 142, 146 or the frames 160, 162, 164, 166, 168, as assembled, may further include a lip 170. The lip 170 may extend from the outer surface 148 of the frame members 134, 136, 138, 140, 142 or the outer facing surface 188 of the frames 160, 162, 164, 166, 168. In some aspects, the lip 170 extends from the window ledge 152 or is otherwise connected to the ledge 152. The lip 170 extends into the opening 172 such that the lip 170 may form a barrier for which the at least one sheet 126 is positioned adjacent to or rests against when the frame members 134, 136, 138, 140, 142, 146 are assembled to form the panel frames 160, 162, 164, 166, 168. In some aspects, the lip 170 and the window ledge 152 are perpendicular to each other forming a 90 degree angle. In one aspect, the at least one sheet 126 may contact both the lip 170 and the window ledge 152 when the at least one sheet 126 is positioned within the respective panel frames 160, 162, 164, 166, 168.

Referring now to FIGS. 1-4, the at least one sheet 126 of material is positioned within, adjacent to or otherwise coupled to the frames 160, 162, 164, 166, 168, such that the sheets 126 may form a window that provides a full view or substantially full view through the door 100. The sheets 126 of material are positioned adjacent to the panel frames 160, 162, 164, 166, 168 such that an outer surface 128 of the sheets 126 are substantially unobstructed by the panel frames 160, 162, 164, 166, 168. In some embodiments, the unobstructed sheets 126 give the multi-panel door 100 a substantially unobstructed view when the door 100 is in the closed position, as will be described in more detail below.

The sheets 126 of material may be made of any suitable material and may be opaque, translucent, semi-translucent, transparent, semi-transparent or a combination of any of the foregoing. For example, in some embodiments the sheets 126 are made of semi-translucent black, white, bronze or mirror silver glass. In other embodiments, the sheets 126 are made of an opaque metal material. In yet other embodiments, the sheets 126 are made of tempered glass that has flame-polished edges to prevent chipping or cracking. In some embodiments, the sheets 126 are made of polycarbonate. The sheets 126 may be partially translucent, partially opaque or a combination of partially translucent and partially opaque. In some aspects, the sheets 126 are rated for use in hurricane prone areas, such as the state of Florida in the United States of America, so that the sheets 126 are capable of withstanding high wind loads and missile impact from debris. Moreover, the sheets 126 may meet the rating standards set by state or governmental entities in said hurricane prone areas.

The sheets 126 may have any suitable thickness. In some embodiments, for example, the sheets 126 are ⅛ inch thick. In other embodiments, the sheets 126 are thicker or thinner than ⅛ inch. For example, in some embodiments the sheets 126 are ¼ inch thick. The thickness of the sheets 126 may be equal to, less than, or greater than the thickness of the ledge 132. In one illustrative embodiment, the thickness of the sheets 126 is equal to the thickness of the ledge 132. In another embodiment, the thickness of the sheets 126 is less than the thickness of the ledge 132.

The sheets 126 generally have a height and width that are substantially equal to the height and width of the opening 172 formed in the panel frame 160, 162, 164, 166, 168. In other embodiments, multiple sheets 126 are positioned in the opening 172 and fitted against or otherwise coupled to each of the panel frames 160, 162, 164, 166, 168 such that the sheets 126 have a combined height and width that is substantially equal to the height and width of the opening 172 formed by the panel frame 160, 162, 164, 166, 168. In one, nonlimiting embodiment, the sheets 126 are individually or otherwise combined to be 23 inches high by 50 inches wide. In some embodiments, the sheets 126 may have a height greater than or less than 23 inches and may have a width greater than or less than 50 inches. The height and width of the sheets 126 will generally depend on the size of the opening 172 formed by the panel frames 160, 162, 164, 166, 168.

The sheets 126 have an outer surface 128, an opposing inner surface 130 and an edge 129. The outer surface 128 of the sheets 126 includes a periphery 131 adjacent to the edge 129. The inner surface 130 of the sheets 126 also includes a periphery 133 adjacent to the edge 129. The periphery 131 along the outer surface 128 of the sheet 126 may be positioned adjacent to the lip 170, with the edge 129 of the sheet 126 being positioned adjacent to the ledge 132.

In some aspects, a groove 156 is formed in the inner surface 130 of the sheets 126 within the periphery 133. The groove 156 may be completely hidden behind the lip 170 in some embodiments when the sheet 126 is positioned in the opening 172. In other embodiments the groove 156 may only be partially hidden behind the lip 170 or not hidden behind the lip 170 at all. The groove 156 is configured to be connected to the retainer member 152 to help secure the sheets 126 in place within the opening 172 and may help prevent the sheets 126 from slipping from or coming uncoupled from the frames 160, 162, 164, 166, 168 under high wind loads or upon debris impact.

Figure 5:
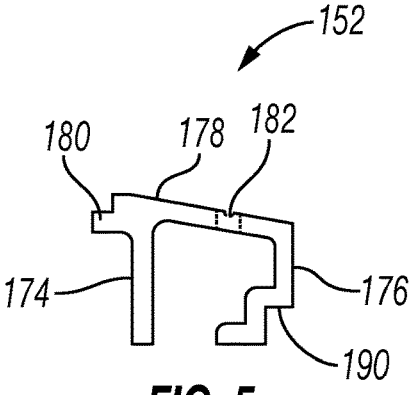
FIG. 5 is a cross section view of a retainer member of FIG. 4.

The retainer member 152 may be formed of an extruded metal such as aluminum and is operable to be positioned against the inner surface 130 of the one or more sheets 126 and to be fastened to the panel frames 160, 162, 164, 166, 168 to secure the one or more sheets 126 within the opening 172. In the embodiment illustrated in FIG. 5, the retainer member 152 includes a first side 174, an opposing second side 176 and a top side 178 that extends between the first side 174 and the second side 176 connecting the first and second sides 174, 176. The first side 174 of the retainer member 152 is configured to be positioned against the periphery 133 of the inner surface 130 of the sheets 126. In some embodiments, a rib or protrusion 180 extends from the first side 174 of the retainer member 152 and is sized to fit securely within the groove 156 formed in the periphery 133 of the inner surface 130 of the sheets 126. In yet some embodiments, the retainer member 152 includes a shoulder 190 formed along the second side 176 that is configured to be positioned against the second protrusion 159 that extends from the shoulder 154 of the frames 160, 162, 164, 166, 168, as illustrated, for example, in FIG. 4. In some aspects, the second side 176 of the retainer member 152 is positioned internal to the second protrusion 159. Additionally, in some aspects, the first side 174 of the retainer member 152 is positioned external to the first protrusion 158. In yet some aspects, the first side 174 of the retainer member 152 is positioned between the ledge 132 and the first protrusion 158. A bottom portion of the first side 174 of the retainer member 152 and a bottom portion of the second side 176 of the retainer member 152 may contact the shoulder 154 of the frames 160, 162, 164, 166, 168.

In some embodiments the first side 174 of the retainer member 152 has a height greater than the opposing second side 176. In yet some embodiments, the height of the first side 174 is greater than that of the second side 176 such that the top side 178 is angled due to the first side 174 having a height greater than the height of the second side 176. For example, the top side 178 may be angled at 30 degrees, less than 30 degrees or greater than 30 degrees. In some embodiments the height of the first side 174 of the retainer member 152 is approximately 0.5 inches. In other embodiments, the height of the first side 134 may be greater than or less than 0.5 inches. In some embodiments the height of the first side 174 of the retainer member 152 is approximately 0.4 inches. In other embodiments, the height of the first side 134 may be greater than or less than 0.4 inches.

The top side 178 of the retainer member 152 includes a plurality of apertures 182 formed therein for receiving fasteners 184. The fasteners 184 may secure the retainer member 152 to the panel frames 160, 162, 164, 166, 168. The fasteners 184 may be fastened into the panel frames 160, 162, 164, 166, 168 at an angle of approximately 30 degrees. In some embodiments, the fasteners 184 may be fastened into the panel frames 160, 162, 164, 166, 168 at an angle corresponding to the angle of the top side 178 of the retainer member 152. The fasteners 184 may be attached to the panel frames 160, 162, 164, 166, 168 via the shoulder 154. In some aspects, the fasteners 184 are positioned adjacent to the protrusion 158 that extends from the shoulder 154. In yet some aspects, the fasteners 184 are positioned adjacent to the first protrusion 158 and between the first protrusion 158 and the second side 176 of the retainer member 152.

In some embodiments, a majority of the inner and outer surfaces 130, 128 of the sheets 126 are unobstructed by the panel frames 160, 162, 164, 166, 168 and the retainer member 152 so that the door 100 has a principally transparent or translucent appearance when the sheets 126 are made of a transparent or translucent material. In some embodiments, for example, more than seventy percent of the inner and outer surfaces 130, 128 of the sheets 126 are unobstructed by the panel frames 160, 162, 164, 166, 168 and the retainer member 152. In other embodiments, more than sixty percent of the inner and outer surfaces 130, 128 of the sheets 126 are unobstructed by the panel frames 160, 162, 164, 166, 168 and the retainer member 152. In yet other embodiments, more than fifty percent of the inner and outer surfaces 130, 128 of the sheets 126 are unobstructed by the panel frames 160, 162, 164, 166, 168 and the retainer member 152.

Additionally, a coupling mechanism 150, as illustrated in the nonlimiting embodiment of FIG. 4, may further be utilized. The coupling mechanism 150 may be positioned between the lip 170 and the outer surface 128 of the sheets 126. In some embodiments, the coupling mechanism 150 is a layer of adhesive, a layer of double-sided tape or some other coupling object. In some embodiments, the coupling mechanism 150 is a double-sided tape, such as 4991 VHB tape made by 3M Company of Maplewood, Minn. In other embodiments, the coupling mechanism 150 is an adhesive, such as Adseal 4549 silicone based adhesive made by AdChem Corporation of Riverhead, N.Y. The coupling mechanism 150 may be any suitable adhesive, double-sided tape or other coupling mechanism in other embodiments.

In operation, the frame members 134, 136, 138, 140, 142, 146 are assembled to form the frames 160, 162, 164, 166, 168, which forms the door 100. The sheets 156 are positioned within the frame 160, 162, 164, 166, 168 such that the outer surface 128 of the sheet 126 is positioned against or adjacent to the lip 170. The lip 170 acts as a barrier that retains the sheet 126 within the frame 160, 162, 164, 166, 168. The edge 129 of the sheet 126 is positioned adjacent to the ledge 132 of the frame 160, 162, 164, 166, 168. In some embodiments, the sheet 126 contacts at least a portion of the ledge 132. In others, the sheets float within the frame 160, 162, 164, 166, 168, not contacting the ledge 132 and are held in place by the coupling mechanism 150, the retainer member 152 or a combination thereof. The retainer member 152 is positioned adjacent to the inner surface 130 of the sheet 126 to retain the sheet 126 within the frame 160, 162, 164, 166, 168. The sheet 126 is essentially sandwiched between the lip 172 and the retainer member 152.

In some embodiments, the sheet 126 includes the groove 156 formed along the periphery 133 of the inner surface 130 of the sheet 126. The retainer member 152 may include the rib 180 that is configured to mate with the groove 156 formed in the sheet 126. The rib 180 and the groove 156 may be any suitable size to allow the rib 180 to mate with or otherwise engage the groove 156. It should be appreciated, that in some embodiments either or both the rib 180 and the groove 156 may not be present. Likewise, in some embodiments the rib 180 may not engage the groove 156 while otherwise engaging the inner surface 130 of the sheet 126.

The one or more fasteners 184 may be positioned through the apertures 182 formed in the retainer member 152, such that the fasteners 184 engage the frame 160, 162, 164, 166, 168 to couple the retainer member 152 to the frame 160, 162, 164, 166, 168. In one illustrative embodiment, the fasteners 184 are inserted into the shoulder 154 of the frame 160, 162, 164, 166, 168 at an angle. In some embodiments, the first protrusion 158 and the second protrusion 159 extend from the shoulder 154 of the frame 160, 162, 164, 166, 168 to engage with portions of the retainer member 152 to secure the retainer member 152 to the frame 160, 162, 164, 166, 168. For example, the first protrusion 158 may engage with the first side 174 of the retainer member 152 and the second protrusion 159 may engage with the second side 176 of the retainer member 152, and, specifically the shoulder 190 formed in the second side 176 of the retainer member 152.

In some embodiments, the first side 174 of the retainer member 152 is positioned between the ledge 132 and the first protrusion 158 that extends from the shoulder 154 portion of the frame 160, 162, 164, 166, 168. In yet some embodiments, the second protrusion 159 extending from the shoulder 154 portion of the frame 160, 162, 164, 166, 168 engages the shoulder 190 formed on the retainer member 152 to secure the retainer member 152 to the frame 160, 162, 164, 166, 168. The first and second protrusions 158, 159 that extend from the shoulder 154 of the frame 160, 162, 164, 166, 168 may prevent lateral movement of the retainer member 152 when the first or second protrusions 158, 159 engage the retainer member 152.

Figure 6:
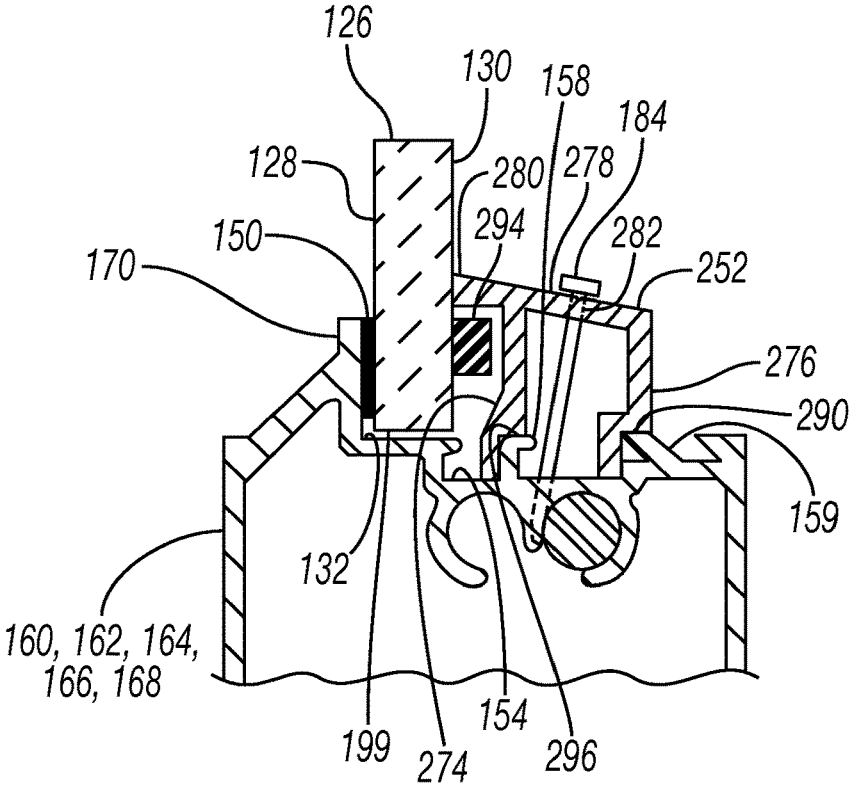
FIG. 6 is a partial cross section view of an assembled panel illustrating the coupling of a panel frame, a transparent member and a retainer member according to an embodiment of the multi-panel door.

Referring now to FIG. 6, another embodiment of a retainer member 252 is presented. The retainer member 252 includes a first side 274, a second side 276, and a top side 278. A protrusion or rib 280 extends from the first side 274 of the retainer member 252 and contacts the inner surface 130 of the sheet 126. Due to the positioning of the protrusion 280, the protrusion 280 may also be described as extending from the top side 278 of the retainer member 252 beyond the first side 274. In this embodiment, the first side 274 may have a height greater than the second side 276 thereby causing the top side 278 to be slanted or angled. The top side 278 may have an angle of 30 degrees. In other embodiments, the top side 278 may have an angle greater than or less than 30 degrees.

In the nonlimiting, exemplary embodiment illustrated in FIG. 6, the sheet 126 does not include a groove along the periphery 133 of the inner surface 130 of the sheet 126. As illustrated, however, a seal 294 is optionally attached along the periphery 133 of the inner surface 130 of the sheet 126. The seal 294 may be positioned along the inner surface 130 of the sheet 126 such that when the sheet 126 and the retainer member 252 are coupled to the frame 160, 162, 164, 166, 168 the seal 294 is positioned below the protrusion 280. In this embodiment, the seal 294 is between the protrusion 280 and the ledge 132 of the frame 160, 162, 164, 166, 168. The second side 276 at the retainer member 252, which faces an interior space of the garage, includes a second shoulder 290 that engages with the second protrusion 159 that extends from the shoulder 154 portion of the frame 160, 162, 164, 166, 168. The first side 274 of the retainer member 252 may also include a first shoulder 296 that engages with the first protrusion 158 that extends from the shoulder 154 portion of the frame 160, 162, 164, 166, 168. In some aspects, the protrusion 280 is hidden by the lip 170. In other aspects, the protrusion 280 is not hidden by the lip 170 or is only partially hidden by the lip 170. In the illustrative embodiment, the first protrusion 158, extending from the shoulder 154 at least partially engages the fasteners 184.

Figure 7:
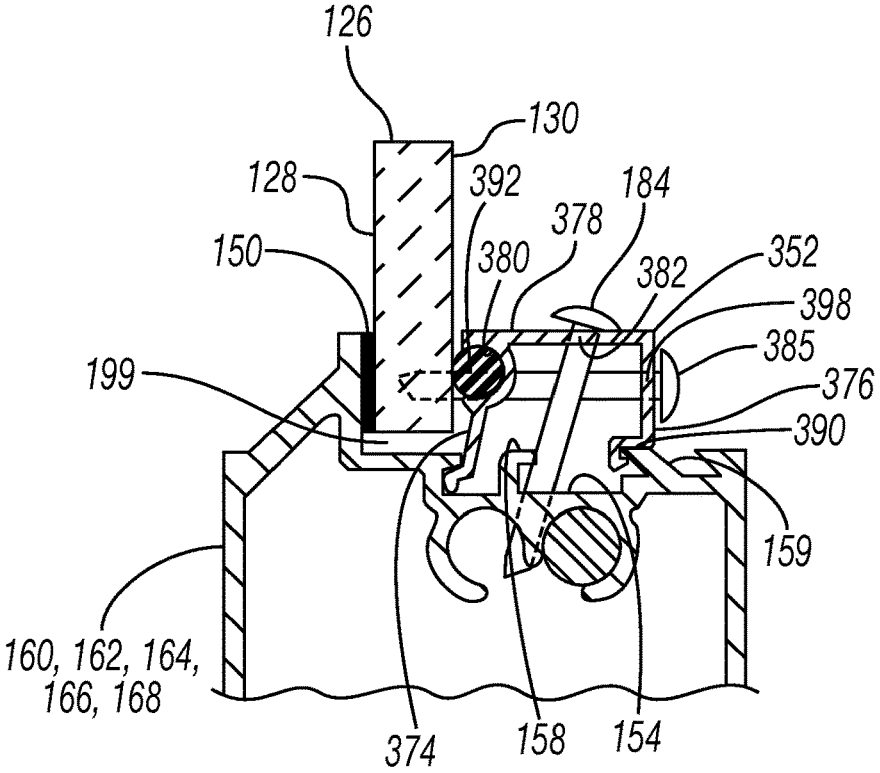
FIG. 7 is a partial cross section view of an assembled panel illustrating the coupling of a panel frame, a transparent member and a retainer member according to an embodiment of the multi-panel door.

Referring now to FIG. 7, yet another embodiment of a retainer member 352 is presented. The retainer member 352 includes a first side 374, a second side 376, and a top side 378. The retainer member 352 includes a cavity 380 for receiving a seal 392. The seal 392 is positioned between the inner surface 130 of the sheet 126 and the cavity 380. In some aspects, only the seal 392 contacts the sheet 126 such that a gap is formed between the inner surface 130 of the sheet 126 and the first side 374 of the retainer member 352. The seal 392 may be rounded or any suitable shape. The cavity 380 may also be any suitable shape such as rounded, crescent-shaped, semicircular or other shape operable to engage the seal 392.

The first side 374 may have a height greater than the second side 376 of the retainer member 352. However, in this embodiment, the top side 378 of the retainer member 352 may be substantially parallel to the shoulder 154 portion of the frame 160, 162, 164, 166, 168. In other words, the top surface 378 of the retainer member 352 may not be angled as may be the case in previous embodiments described herein. A second shoulder 390 may be formed in the second side 376 of the retainer member 352 such that the second protrusion 159, extending from the shoulder area 154 of the frame 160, 162, 164, 166, 168, may engage the second shoulder 390.

The fasteners 184 may be positioned through apertures 382 formed within the top side 378 of the retainer member 352 to secure the retainer member 352 to the frame 160, 162, 164, 166, 168. The fasteners 184 may be inserted into the retainer member 352 at an angle of approximately 30 degrees relative to the shoulder 152, and as illustrated, the top surface 378 of the retainer member 352. In addition to the fasteners 184, additional fasteners 385 may be inserted through apertures 398 formed in the first and the second sides 374, 376 of the retainer member 352 and into the sheet 126. The fasteners 385 may be inserted into the sheet 126 such that the fasteners 385 are substantially perpendicular to the inward facing side 130 of the sheet 126. The fasteners 385 may provide an additional mechanism for attaching the retainer member 352 to the sheets 126 to further secure the sheets 126 within the frames 160, 162, 164, 166, 168.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "outer" and "inner," "upper" and "lower," "first" and "second," "internal" and "external," "above" and "below" and the like are used as words of convenience to provide reference points and are not to be construed as limiting terms.

In addition, the foregoing describes only some embodiments of the invention(s), and alterations, modifications, additions and/or changes can be made thereto without departing from the scope and spirit of the disclosed embodiments, the embodiments being illustrative and not restrictive.

Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

Although specific embodiments have been described in detail, those skilled in the art will also recognize that various substitutions and modifications may be made without departing from the scope and spirit of the appended claims.

What is claimed is:

1. A panel of a sectional door, the panel comprising:

a panel frame comprising a top frame member, a bottom frame member, a first side frame member and a second side frame member, wherein the frame members form an opening, each of the frame members comprising:

a rear surface and a front surface;

a ledge at least partially extending between and being substantially perpendicular to the rear surface and the front surface;

a shoulder at least partially extending between the rear surface and a rear end of the ledge and being offset from the ledge away from the opening and parallel to the ledge, the shoulder comprising at least one protrusion extending outwardly therefrom; and a lip extending from a front end of the ledge into the opening; and a sheet of material disposed within the opening, wherein the ledge of each frame member extends from a front side of the sheet of material to a rear side of the sheet of material.

2. The panel of claim 1, wherein the sheet of material is positioned adjacent the lip and the ledge such that an edge of the sheet is positioned adjacent the ledge and a periphery of an outer surface of the sheet is positioned against the lip.

3. The panel of claim 2, wherein the edge of the sheet directly contacts at least a portion of the ledge.

4. The panel of claim 1, wherein the lip and the ledge are perpendicular to each other.

5. The panel of claim 1 further comprising a retainer member, the retainer member being fastened to one or more of the frame members by a fastener extending through a portion of the retainer member and into the shoulder.

6. The panel of claim 1, wherein the frame members are aluminum extrusions.

7. A panel for an overhead door comprising:

a frame defining an opening, the frame having a first surface and a second surface parallel to the first surface and a ledge oriented substantially perpendicular to the first and second surfaces, the frame further comprising a lip extending from the ledge into the opening and a shoulder at least partially extending between the ledge and the second surface, the shoulder comprising at least one protrusion extending outwardly therefrom;

a transparent member having a first side and an opposing second side, the transparent member positioned parallel to the first and second surfaces of the frame and adjacent to both the lip and the ledge with the first side of the transparent member disposed adjacent the lip; and a retainer member disposed adjacent the second side of the transparent member and operable to be fastened to the frame with a fastener extending through a portion of the retainer member to secure the transparent member within the opening of the frame, the retainer member being engaged with the at least one protrusion to prevent lateral movement of the retainer member with respect to the shoulder.

8. The panel of claim 7, wherein the second side of the transparent member includes a groove.

9. The panel of claim 7, wherein the fastener is inserted into a top side of the retainer member, wherein the top side is oriented at an angle of approximately 30 degrees relative to the ledge.

10. The panel of claim 7, further comprising a coupling member operable to fasten the transparent member to the lip.

11. The panel of claim 7, wherein the lip and the ledge are perpendicular to each other.

12. The panel of claim 7, wherein the retainer member comprises a shoulder disposed upon a first protrusion of the at least one protrusion.

13. The panel of claim 7, wherein the second surface of the panel is an inward facing surface configured to face an interior portion of a space enclosed by the overhead door.

14. A panel for an overhead door comprising:

a frame defining an opening, the frame having a first surface and a second surface parallel to the first surface and a ledge oriented substantially perpendicular to the first and second surfaces, the frame further comprising a lip extending from the ledge into the opening and a shoulder at least partially extending between the ledge and the second surface, the shoulder comprising at least one protrusion extending outwardly therefrom;

a transparent member having a first side and an opposing second side, the transparent member positioned parallel to the first and second surfaces of the frame and adjacent to both the lip and the ledge with the first side of the transparent member disposed adjacent the lip; and a retainer member disposed adjacent the second side of the transparent member and operable to be fastened to the frame to secure the transparent member within the opening of the frame, the retainer member being engaged with the at least one protrusion to prevent lateral movement of the retainer member with respect to the shoulder, wherein the retainer member has a rib disposed within a groove formed along a periphery of the transparent member.

15. A panel for an overhead door comprising:

a frame defining an opening, the frame having a first surface and a second surface parallel to the first surface and a ledge oriented substantially perpendicular to the first and second surfaces, the frame further comprising a lip extending from the ledge into the opening and a shoulder at least partially extending between the ledge and the second surface, the shoulder comprising at least one protrusion extending outwardly therefrom;

a transparent member having a first side and an opposing second side, the transparent member positioned parallel to the first and second surfaces of the frame and adjacent to both the lip and the ledge with the first side of the transparent member disposed adjacent the lip; and a retainer member disposed adjacent the second side of the transparent member and operable to be fastened to the frame to secure the transparent member within the opening of the frame, the retainer member being engaged with the at least one protrusion to prevent lateral movement of the retainer member with respect to the shoulder, wherein the at least one protrusion comprises a first protrusion and a second protrusion, wherein a first side of the retainer member is disposed between the ledge and the first protrusion, and wherein a second side of the retainer member is disposed between the first protrusion and the second protrusion.

16. A panel of a sectional door, the panel comprising:

a panel frame comprising a top frame member, a bottom frame member, a first side frame member and a second side frame member, wherein the frame members form an opening, each of the frame members comprising:

a rear surface and a front surface;

a ledge at least partially extending between the rear surface and the front surface;

a shoulder at least partially extending between the rear surface and the ledge and being offset from the ledge;

a first protrusion and a second protrusion each extending outwardly from the shoulder; and a lip extending from the ledge into the opening; and a retainer member attached to the panel frame to secure a sheet of material within the opening of the panel frame, the retainer member engaged with both the first protrusion and the second protrusion.

* * * * *